United States Patent [19]

Gilbert et al.

[11] 4,075,637

[45] Feb. 21, 1978

[54] ELECTROSTATIC MULTI-COPIER

[75] Inventors: Joseph Gilbert, Ilford; Malcolm McKenzie McRobbie, Brentwood; Wilfred Gee, New Barnet, all of England

[73] Assignee: Ozalid Group Holdings Limited, Loughton, England

[21] Appl. No.: 696,805

[22] Filed: June 16, 1976

[51] Int. Cl.[2] ..... G03G 15/09

[52] U.S. Cl. ..... 346/153; 346/155

[58] Field of Search ..... 346/153, 155; 358/300; 101/DIG. 13

[56] References Cited

U.S. PATENT DOCUMENTS

| | | | |
|---|---|---|---|
| 3,132,962 | 5/1964 | Seymour | 346/153 |
| 3,194,674 | 7/1965 | Sakurai | 346/153 |
| 3,267,840 | 8/1966 | Honma | 346/153 |
| 3,931,627 | 1/1976 | Cantarano | 346/153 |

OTHER PUBLICATIONS

Electrostatic Printing, V. Rothgordt, Phillips Technical Review, vol. 36, No. 3, p. 57ff, 10/76.

*Primary Examiner*—Jay P. Lucas

*Attorney, Agent, or Firm*—Birch, Stewart, Kolasch & Birch

[57] ABSTRACT

A method of electrostatic printing from a master constituted by a sheet of material bearing an image to be duplicated, in which the image area of the master has an electrical resistivity which is substantially greater than that of the background area. The method comprises mounting the master on a rotating cylinder and, during each of a series of successive cycles of operation, applying toner powder to the electrically charged image areas of the master, traversing the master by rotation of the cylinder to a station at which it contacts successive portions of a transfer sheet which is pressed against the master by a charge transfer roller connected to a source of electrical potential such that the toner is transferred to the transfer sheet and the image is recharged upon separation of the transfer sheet from the master, and thereafter fixing the toner powder to the transfer sheet.

8 Claims, 8 Drawing Figures

ELECTROSTATIC MULTI-COPIER

BACKGROUND OF THE INVENTION

Electrostatic copying machines are known which comprise a rotatable cylinder which bears a surface layer of photoconductive material and which, as it rotates, brings successive parts of its surface first to a charging station, at which an electrostatic charge is imparted to the surface by a corona generator, then to an exposure station at which an image of a master to be duplicated is projected by an optical system to produce on the surface a charge pattern corresponding to the image areas of the master, then to a developing station at which a toner powder is applied to the image areas of the surface and finally to a transfer station at which the toner powder is transferred from the cylinder to a transfer sheet, which is thereafter subjected to treatment to fix to it the transferred toner powder. Such machines are expensive owing to the cost of the optical system and the corona generator and to the large amount of electrical power required for operation of the corona generator.

U.S. Pat. No. 2576047 discloses an electrostatic duplicator which uses a rotating cylinder carrying a metal master bearing an image of high electrical resistivity. It uses corona generators both to charge the image and to assist in transferring the toner to a continuous roll of transfer material. Each of the numerous corona generators used needs 6KV to operate it and corona generators are known to be difficult to maintain in a condition in which they apply an even charge to a master. This machine has not been put into use commercially.

SUMMARY OF THE INVENTION

The present invention provides a method of electrostatic printing from a master constituted by a sheet of material bearing an image to be duplicated, in which the image area of the master has an electrical resistivity which is substantially greater than that of the background area. The method comprises mounting the master on a rotating cylinder and, during each of a series of successive cycles of operation, applying toner powder to the electrically charged image areas of the master, traversing the master by rotation of the cylinder to a station at which it contacts successive portions of a transfer sheet which is pressed against the master by a charge transfer roller connected to a source of electrical potential such that the toner is transferred to the transfer sheet and the image is recharged upon separation of the transfer sheet from the master, and thereafter fixing the toner powder to the transfer sheet.

The invention also includes an electrostatic duplicator, comprising a rotatable cylinder for supporting a master constituted by a sheet of material bearing an image to be duplicated, the image area of the master having an electrical resistivity which is substantially greater than that of the background area, means for rotating the cylinder. The present invention also includes an applicator for applying toner powder to the image area of the master on the cylinder, means for feeding transfer sheet material repeatedly into a nip between the cylinder and a charge transfer roller, to which nip the master is advanced from the applicator by rotation of the cylinder. Further, the present invention includes a source of electrical potential connected to the charge transfer roller, the charge transfer roller operating not only to cause toner powder to be transferred from the master to the transfer sheet material but also to cause the image area of the master to receive sufficient electrical charge upon removal of the toner and transfer sheet to enable the image area to pick up toner powder from the applicator, and being the sole agency for imparting charge to the master, and a unit for fixing the toner powder to the transfer sheet material.

The present invention renders it possible to reduce the cost of an electrostatic duplicator by not only dispensing with an optical system by the use of a suitable prepared master but also by dispensing with the use of corona generators and relying on a charge transfer roller, which operates at the transfer station to assist in the transfer of the developer or toner powder to a transfer sheet. As a result of such a transfer a sufficient electrostatic charge is imparted to the master to ensure adequate transfer of toner powder to the image areas of the master at the developing station.

The first transfer sheet fed to the nip will operate only to permit charge to be imparted to the image area of the master and will receive no toner powder. The charged master will thereafter acquire toner powder from the applicator and transfer toner powder from its image area to each following transfer sheet which is passed through the nip.

Other objects and further scope of applicability of the present invention will become apparent from the detailed description given hereinafter; it should be understood, however, that the detailed description and specific examples, while indicating perferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
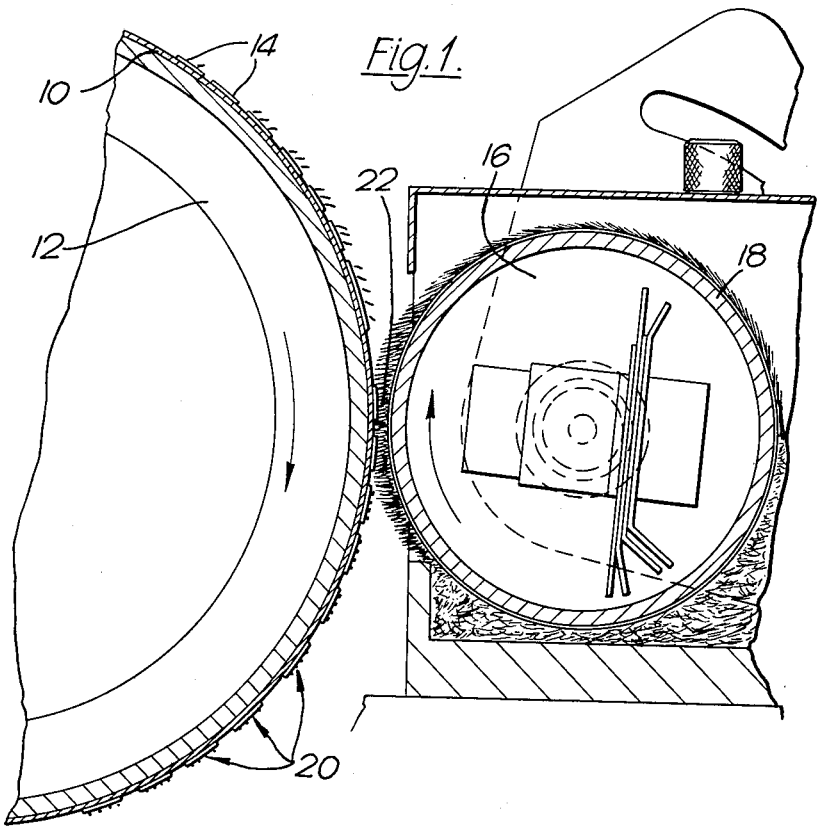
FIGS. 1 and 2 are diagrams illustrating the operation of an electrostatic duplicator according to the present invention.
Figure 2:
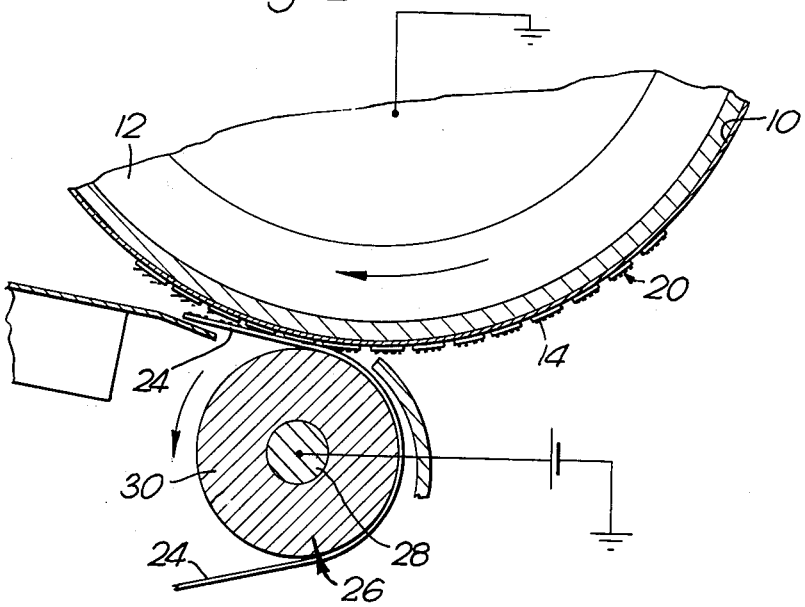
Figure 3:
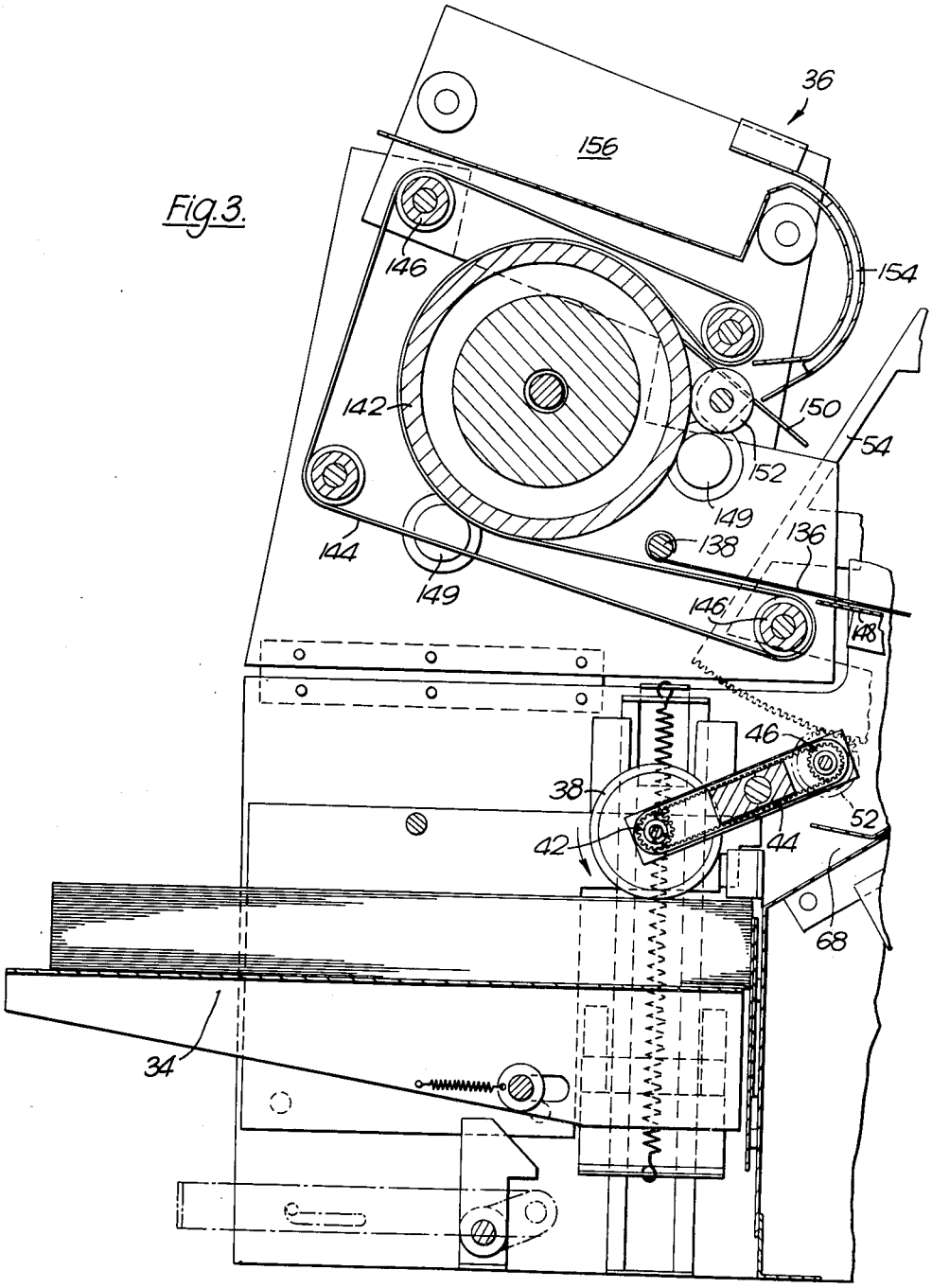
FIGS. 3, 4 and 5 are longitudinal sections showing adjoining portions of a preferred embodiment of duplicator according to the present invention.
Figure 4:
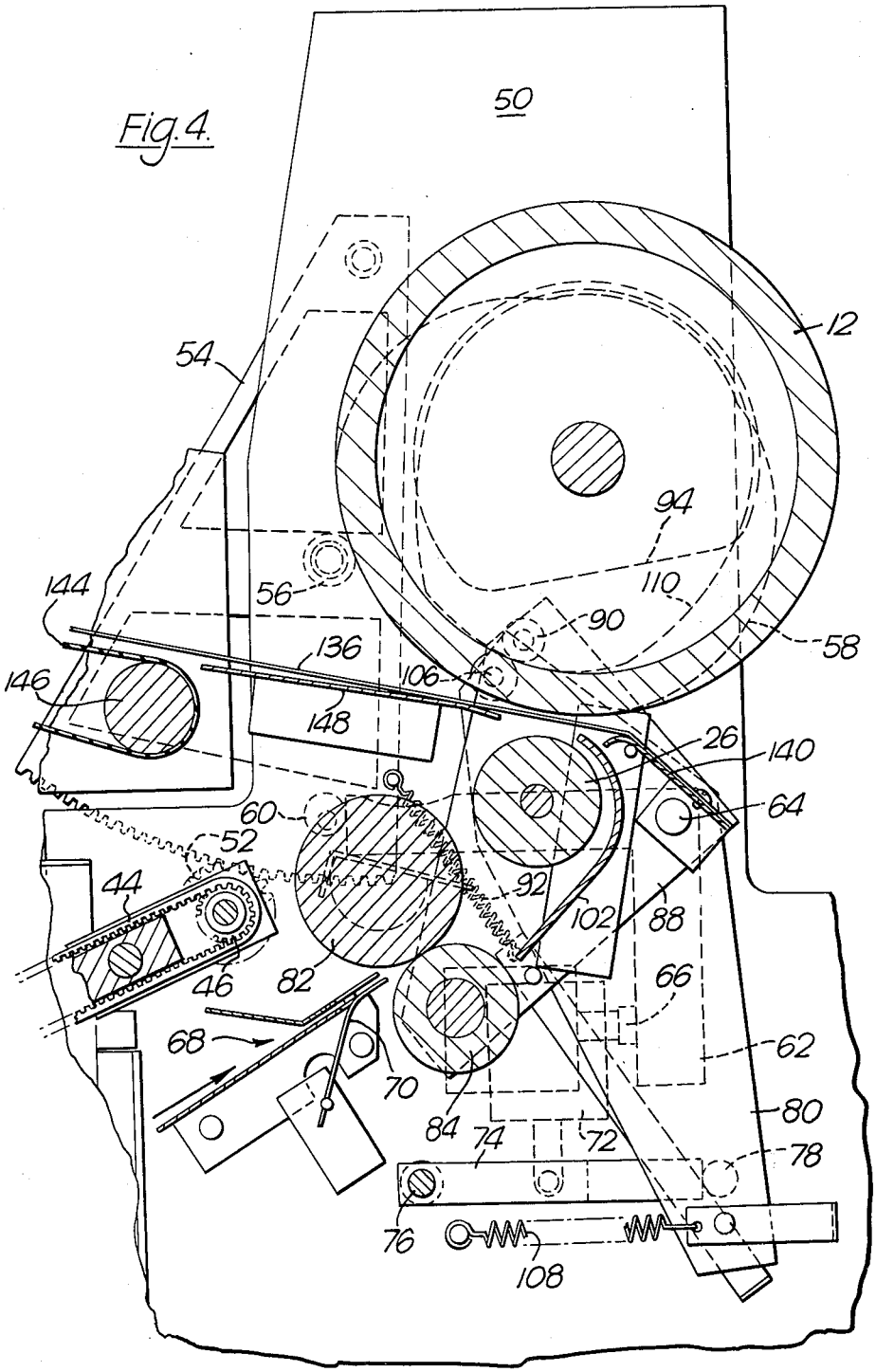

As shown in FIGS. 1 and 2, the duplicator according to the present invention makes copies from a master 10, mounted on a rotating earthed metal cylinder 12 and having outwardly facing image areas 14 of higher electrical resistivity than the background areas. The master 10 may consist of a paper or film base, carrying a coating of a pigment or filler such as clay or zinc oxide, in a resinous binder to which has been applied, e.g. by drawing or typing, image areas of an electrically nonconducting substance such as wax. The background of the master has a resistivity substantially less than that of the image areas.

In operation the cylinder 12 moves past a magnetic brush 16, constituted by a rotating cylinder 18 which contains an internal magnetic system and which, as later described, picks up a mixture of iron filings and toner powder 20. The iron filings project as bristles 22 from the cylinder 18 and transfer the toner powder 20 to the image areas 14, which have been previously given a negative electrostatic charge by means described below. The master 10, carrying the toner powder 20 passes to the transfer station shown in FIG. 2, at which a transfer sheet 24, for example of paper, is traversed through the nip between the cylinder 12 and a charge transfer roller 26, constituted by a central metal shaft 28 and a surrounding rubber sleeve 30. A negative electrical potential is applied to the shaft 28. As the sheet 24 passes through the nip, the toner powder 20 is attracted by passage of current, to the sheet 24 and a negative charge is applied to the image areas 14 of the master.

The machine shown in detail in FIGS. 3 - 7 includes a casing, having front and rear walls 50, 50*a*. The cylinder 12 (FIG. 4) which carries the master in use, rotates clockwise in the casing as viewed in FIG. 4. The machine also includes an applicator 32 (FIG. 5) which applies toner powder to the master by the magnetic brush 16. Further, the machine includes a charge transfer roller 26 (FIG. 4), a magazine 34 (FIG. 3) from which sheets of paper are fed in succession to the nip between the cylinder 12 and the roller 26 and a fixing unit 36. The shaft of the cylinder 12 carries a number of cams which control the operation of the machine in the manner described below.

The magazine 34 carries a stack of horizontally disposed paper sheets which is urged upwardly by a spring. At each cycle of operation the top sheet of the stack is removed by a pair of primary feed rollers 38, which have serrated rubber edges and which engage the upper surface of the sheet. A conventional paper nib (not shown) overlies the leading end of the top sheet and causes the sheet to buckle slightly to assist in its separation from the underlying sheet as it is fed forward.

Figure 7:
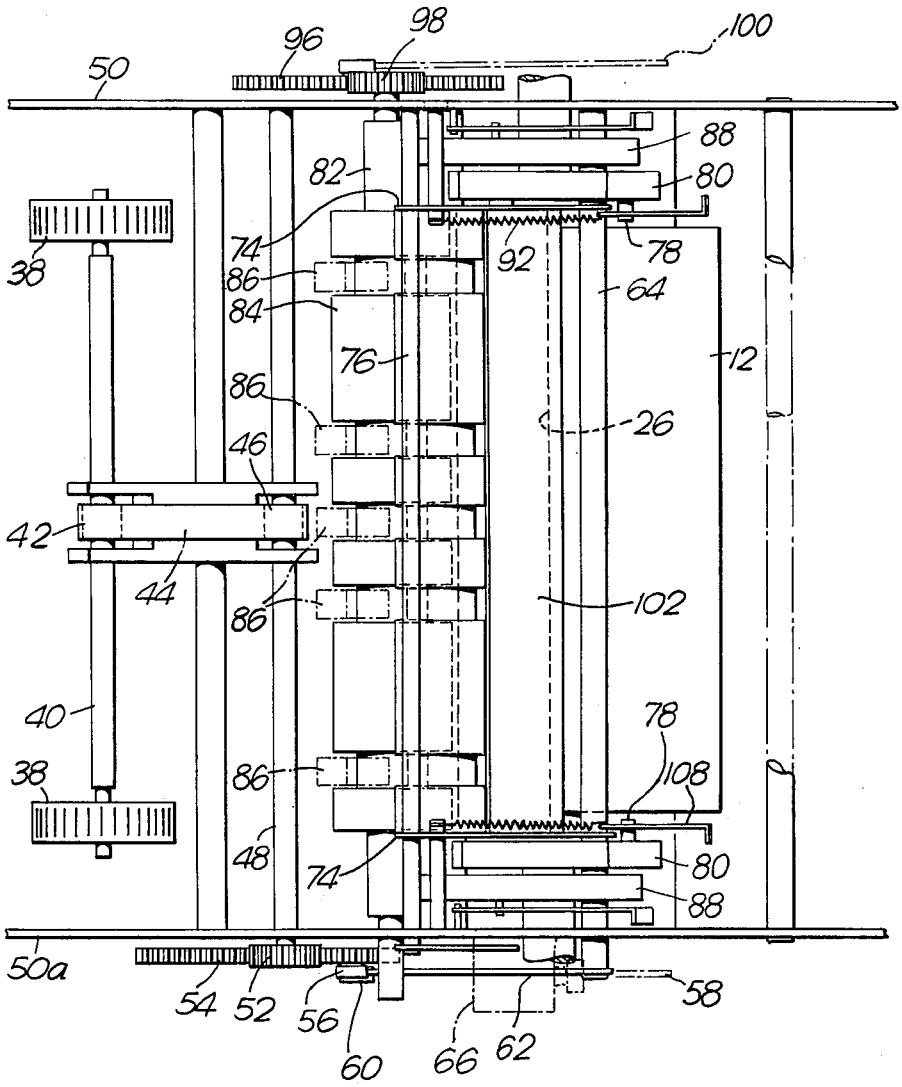
FIG. 7 is an underside plan view showing parts of the mechanism shown in FIGS. 3 – 5.

As shown in FIG. 7, the rollers 38 are mounted on a common shaft 40, carrying a pulley 42 coupled by a belt 44 to a pulley 46 on a shaft 48, which carries outside the rear wall 50*a* of the machine casing a gear 52. The gear 52 meshes with a gear quadrant 54 which is pivoted at its upper end to the wall 50*a* and carries a follower 56 (FIG. 4) which cooperates with a cam 58, towards which the quadrant 54 is biased by a spring (not shown). The quadrant 54 also carries a projection 60. An L-shaped lever 62, pivoted on a spindle 64, coacts with a solenoid 66, which when de-energized maintains the lever 62 in the position shown in FIG. 4, in which it coacts with the projection 60 and so prevents the quadrant rocking counter-clockwise under the control of the cam 58. When the solenoid 66 is energized, the lever 62 is able to rock counter-clockwise to bring its left hand end below the projection 60 and so permit oscillation of the quadrant 54 about its pivot.

As the quadrant 54 oscillates, it causes the rollers 38 to rotate counter-clockwise (FIG. 3) to feed a sheet of paper forward. A one-way clutch associated with the pulley 42 prevents the quadrant 54 from imparting clockwise rotation to the rollers 38 on its return stroke.

The sheet advanced by the rollers 38 passes through a paper feed guide 68 (FIG. 4) and actuates a feeler wire switch 70. This, as later described, causes a solenoid 72 to be energized to rock arms 74 on opposite sides of the machine, which are connected by a rod 76, upwardly clear of projections 78 on arms 80 which are also pivoted on the spindle 64.

The leading end of the paper sheet is fed by the rollers 38 between upper and lower secondary feed rollers 82 and 84 which at this stage are spaced slightly apart. The leading edge of the sheet is registered by stops constituted by fingers 86 projecting from grooves in the roller 82 as shown in FIG. 7.

The roller 84 extends between a pair of arms 88, also pivoted on the spindle 64. One arm 88 carries a follower 90 which is urged by a spring 92 into contact with a cam 94. While the sheet is arrested by the stops 86 the cam 94 allows the spring 92 to rock the arms 88 and raise the roller 84 into feeding relation with the roller 82.

A gear quadrant 96 (FIGS. 6 and 7) disposed outside the front wall 50 meshes with a gear 98 on the roller 82 and carries a follower 96A cooperating with a cam 100 (FIG. 7) by means of which the quadrant 96 is oscillated to rotate the roller 82 and advance the paper sheet after the roller 84 has been raised into feeding relation.

The secondary feed rollers 82, 84 feed the sheet between a guide 102 and the charge transfer roller 26, which extends between and is mounted for rotation in the arms 80. One of the arms 80 carries a follower 106, which is urged by a spring 108 into contact with a cam 110. The cam 110 raises the roller 26 at the appropriate time to nip the leading edge of the paper sheet between the cylinder 12 and the roller 26. The roller 26 maintains the sheet pressed firmly against the master on the cylinder 12 over the entire image area of the master and is moved away from the sheet just before it reaches its trailing end.

Meanwhile the quadrant 54 causes the next sheet to be fed from the magazine, the secondary feed rollers 82, 84 separate and the stops 86 move into position to arrest the next sheet.

During each revolution of the cylinder 12 in normal operation toner powder is applied to the master by the applicator 32. This application of toner alternates with the transfer of charge to the master by the roller 26. The machine uses a dry toner, i.e. a toner mixture comprising powdered iron as a carrier, a pigment, a resinous toner, a dye and other conventional additives. The components of the mixture acquire electrical charge by being agitated together, the resin and additives being such that the toner acquires a positive charge in order to operate with a negatively charged image.

One example of a suitable toner mixture, in parts, by weight, is as follows:

| | | |
|---|---|---|
| Toner | | |
| 60/40 Copolymer of styrene and butyl methacrylate | | 45% |
| Poly-o-methyl styrene | | 30% |
| Polythene wax. (m.p. 106° C) | | 5% |
| "Sudan Deep Black" (RTM) from BASF | | 10% |
| Carbon Black | | 10% |
| Carrier | | |
| Iron powder | 5% < 30 μ<br>95% < 150 μ | 97% of total mix. |

Another is the mixture available from Coates Brothers of Bath, Somerset, under the code numbers V2951 for the iron powder and V2938 for the toner.

Figure 5:
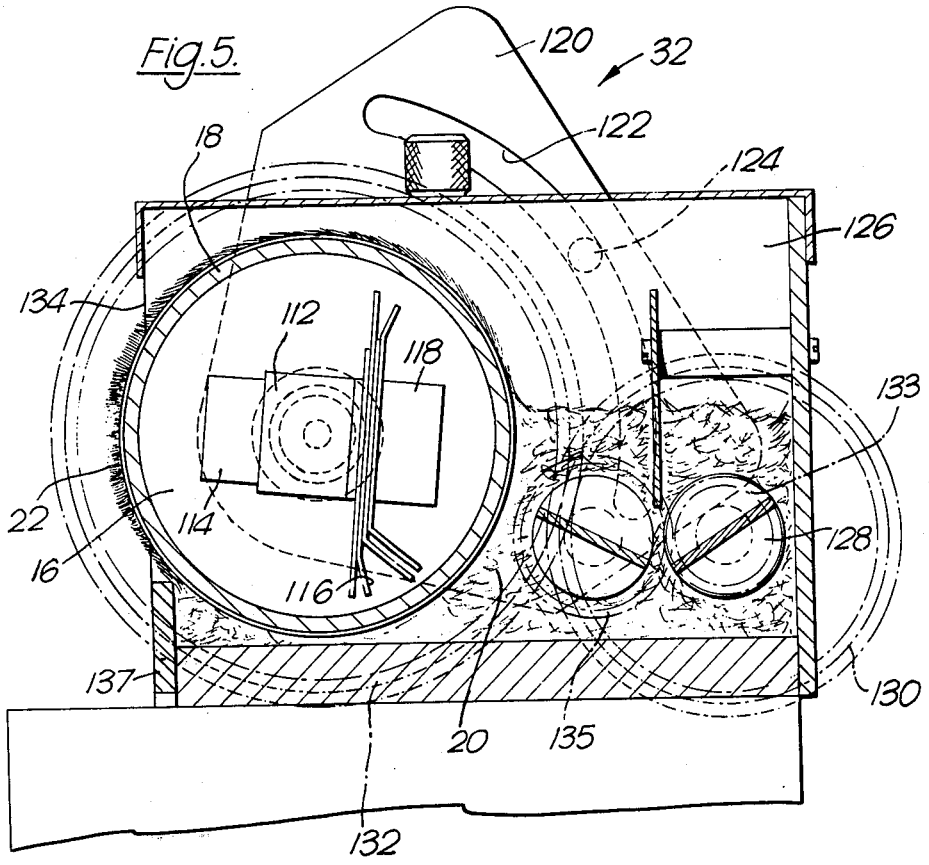

The applicator 32 comprises, as shown in FIG. 5, in addition to the rotating brass cylinder 18, a magnet 112 having a pole piece 114 and a shield 116 disposed within the cylinder as described in British Pat. No. 1405564. The magnet and the shield are attached by aluminum plates 118 to end plates 120 outside the cylinder 18. The plates 120 are angularly adjustable with respect to the rest of the machine, and have arcuate slots 122 through which pass fasteners 124 mounted on a housing 126. The housing 126 contains toner mixture and spiral agitators 128, one of which carries a gear 130 meshing with a gear 132 on the cylinder 18 and a gear 133 meshing with a gear 135 on the other agitator. The wall of the cylinder 18 projects from a slot 134 in the housing 126 and the amount of toner carried by the cylinder is metered by a plate 137 defining the lower edge of this slot. The magnetic brush formed on the cylinder is given an electrical bias to facilitate transfer of toner to the image areas of the master.

After passage between the cylinder 12 and the charge transfer roller 26, the paper sheet is separated from the cylinder by a pair of bands 136 (FIG. 4) of resilient plastics material which overlie the edges of the sheet and extend between a fastener 138 (FIG. 3) and a shield 140 (FIG. 4) extending between the arms 88. These bands are raised into contact with the cylinder 12 as the charge transfer roller 26 is raised to nip the paper.

The paper sheet then passes from the nip, where it receives the toner, to the fixing unit 36. The fixing unit comprises a thin walled metal drum 142 (FIG. 3), containing an internal heater, not shown, and having a non-stick surface coating of silicone rubber, and a belt 144 which extends around four rollers 146. As the paper sheet leaves the cylinder 12 it travels along an earthed plate 148 (FIG. 4) and on to the belt 144, to be carried between the belt 144 and the drum 142 over an arc of about 230°. The tension in the belt 144 urges the drum 142 against pairs of narrow supporting rollers 149 journalled in the casing. The internal heater maintains the surface of the drum 142 at a temperature of about 105° C which is effective to fuse the toner powder transferred to the paper sheet and bond it to the sheet. The sheet is stripped from the drum by fingers 150 which engage in peripheral grooves in the drum disposed beneath the side edges of the sheet. A rotating brush 152 engages the surface of the drum 142. The sheet is deflected by the fingers 150 and the brush 152, and passes through a guide 154 to be deposited, image upwards, in a tray 156.

Other alternative forms of a fixing unit can be used. For example the toner-carrying sheets may be passed through a chamber containing a source of radiant heat.

It is also possible to use a pressure fixing toner instead of a toner which requires exposure to heat to fix it, in which case the toner-carrying sheets may be fixed by passage between appropriately coated nip rollers. The following is an example, in proportions by weight, of a suitable pressure fixing toner:

| | |
|---|---|
| Polyamide resin code Pol 935 | 40% |
| Cyclic ketone resin | 40% |
| Polymekon wax | 10% |
| Spirit soluble negrosine based dye | 2% |
| Carbon black | 8% |

Figure 6:
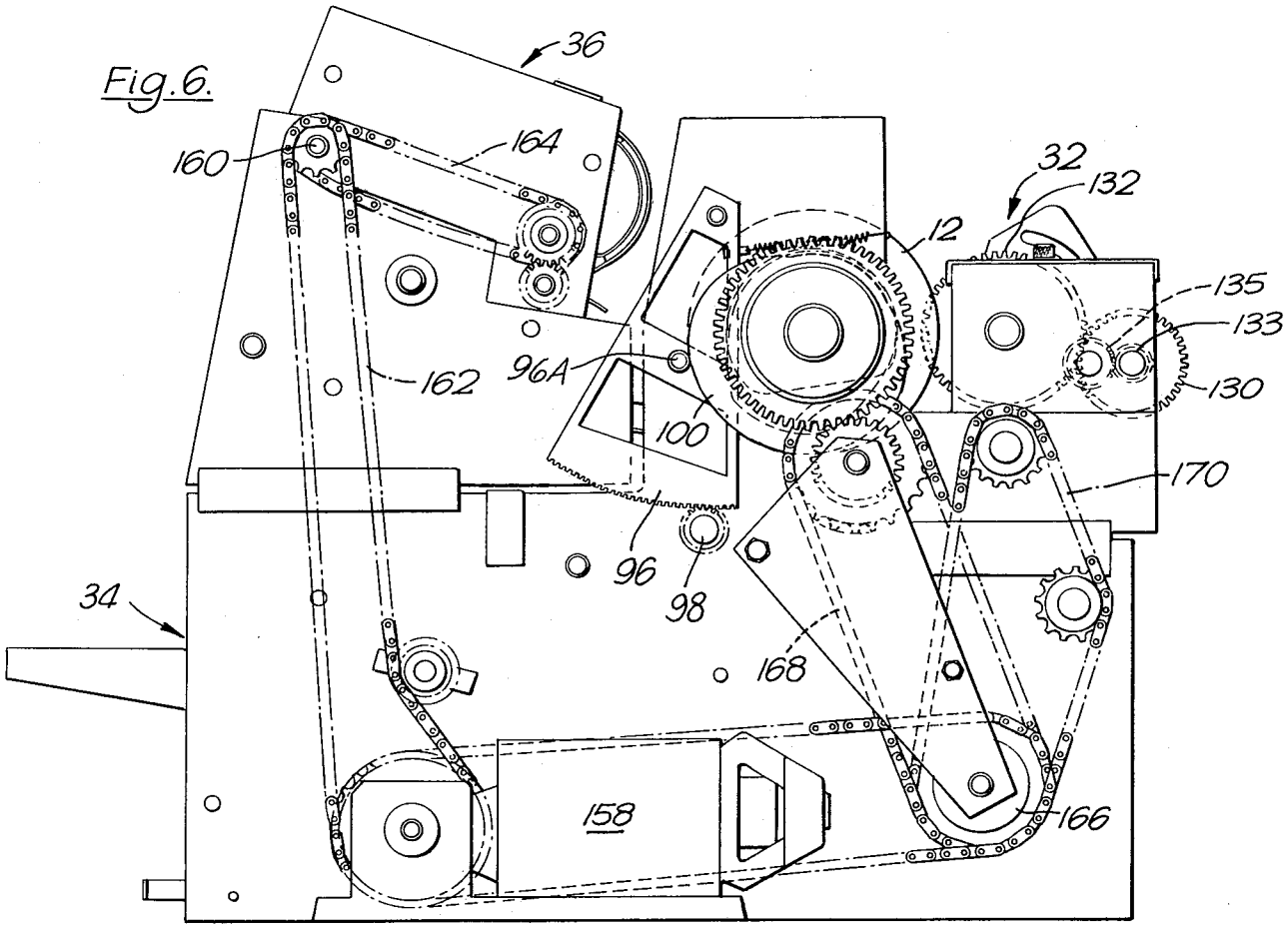
FIG. 6 is a corresponding front elevation on a smaller scale.

As shown in FIG. 6, the machine includes a motor 158 which drives a sprocket 160 attached to the drum 142 of the fixing unit through a chain drive 162 and the brush 152 through another chain drive 164. The motor 158 also drives, through a clutch 166, a chain drive 168 which imparts rotation through gearing to the cylinder 12, and another chain drive 170 which imparts rotation through gearing to the cylinder of the magnetic brush, which drives the toner agitators through the intermeshing gearing described above.

In normal use of the machine, 4 to $4\frac{1}{4}$ KV is applied to the charge transfer roller 26, which is much more than is necessary to transfer the toner from the master but has the effect of efficiently recharging the surface of the master to about 300 volts, which leads to an image potential of about 300 volts and a background potential of about 150 volts when the master reaches the magnetic brush.

The charge transfer roller 26 has a steel shaft having a diameter of 2.2 cm and carrying a rubber sleeve of 0.65 cm thickness and having an electrical resistivity in the range $10^7$ – $10^9$ ohm.cm. and a shore hardness of about 35. The roller passes a current of the order of 25-100 $\mu$A. when the voltage applied to it is between $1\frac{1}{2}$ and 7 KV.

The machine can use a range of easily available plain papers, and produce copies at 75 per minute.

Figure 8:
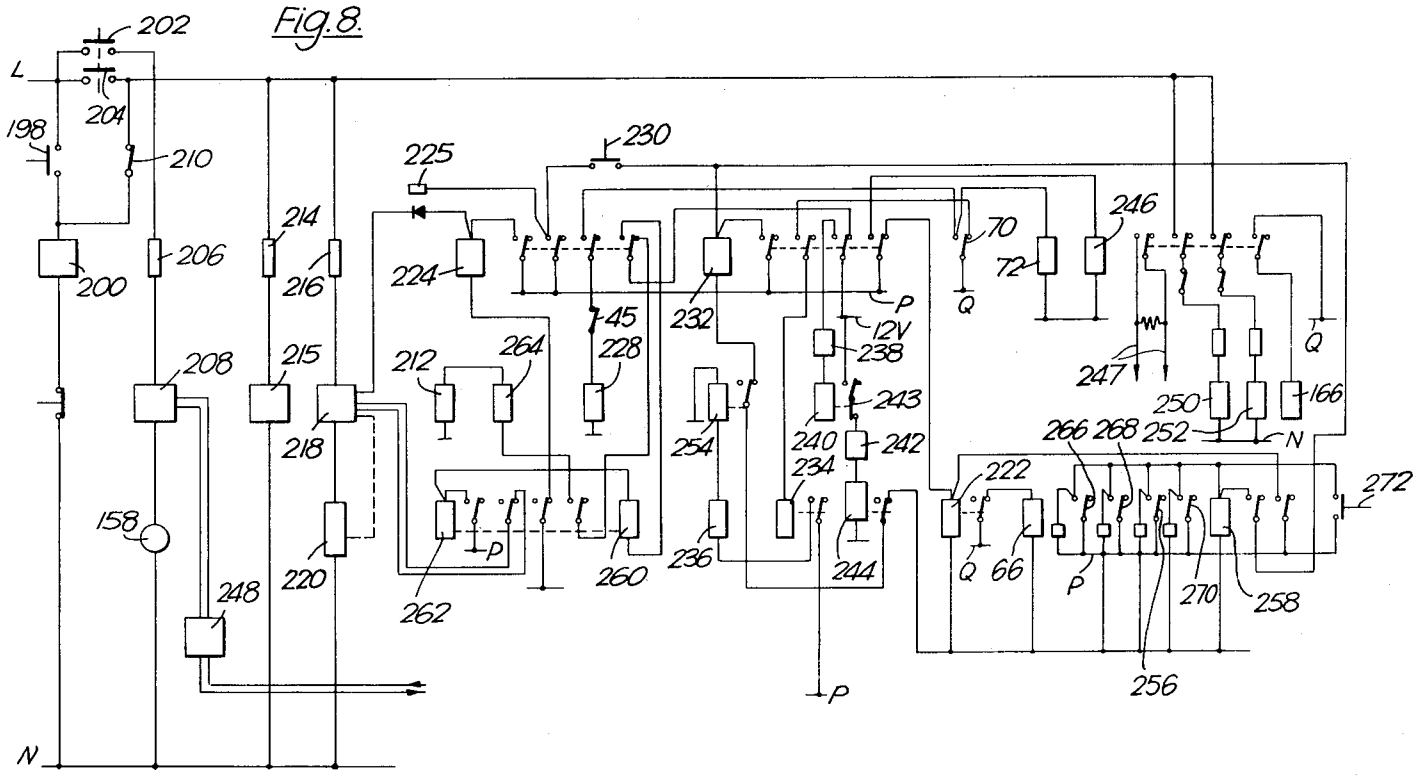
FIG. 8 is an electrical circuit diagram.

FIG. 8 shows diagrammatically the control circuit for the machine. All switches, solenoids and relays are shown in the position which they occupy when the machine is out of operation.

Main supply at 240 volts A.C. passes to the machine through line L. Line N is neutral. When a 'machine on' push button 198 is pressed a contactor 200 is closed and closes contacts 202 and 204. The contact 202 closes a circuit through a fuse 206, a motor control 208 and the motor 158. The normally closed contact 210 of a relay 212 maintains a holding circuit for the contactor 200 when the push button 198 is released. The contact 204 closes many parallel circuits between the lines L and N.

One of these circuits includes a fuse 214 and a D.C. power unit 215 which supplies 12 volts and 24 volts to respective lines P and Q. The coil of each relay and solenoid is connected or is connectable to one of these voltage sources, the other terminal being earthed unless otherwise indicated. Another circuit closed by the contact 204 includes a fuse 216, a heater control 218 and the heater 220 which is disposed in the drum of the fixing unit.

At this stage the clutch 166 (FIG. 6) is disengaged so that the motor 158 operates only the fixing unit 36. Application of voltage to the lines P energizes a relay 222 to shift its contact and thereby prevent current passing to the solenoid 66, thus preventing operation of the quadrant 54 which drives the primary feed rollers 38. When the heater 220 attains the necessary operating temperature, an associated thermocouple causes the control 218 to emit a pulse which energizes a relay 224 and changes over the four contacts shown to the right thereof in FIG. 8. Considering each of those contacts in order, the first establishes a holding circuit for the relay 224, the second illuminates a lamp 225 which indicates that the machine is ready for operation, the third connects a subtractive counter 228 on which has been set up the number of copies to be made, to one terminal of the feeler wire switch 70. The fourth contact changes to deenergize a timer 260.

On seeing that the lamp 225 is lit the operator presses a 'print' button 230 which actuates a relay 232 and shifts the four contacts shown to the right thereof in FIG. 8. In order, the first establishes a holding circuit for the relay 232. The second causes a voltage through the open switch 70 to energize a reed relay 234 which actuates a timer 236. The third contact in the relay 232 energizes a timer 238 and an associated relay 240 which, after a short time delay, operates to connect a timer 242 in circuit through a gravity switch 243. The fourth contact of the relay 232 disconnects the relay 222, thus permitting the solenoid 66 to be actuated to release the quadrant 54 which drives the primary feed roller 38. The fourth contact also energizes a relay 246. Of the four contacts to the right of the relay 246, the first sends a signal through lines 247 to a control 248 to cause the motor 158 to run at full speed, the second causes a high tension unit 250 to apply voltage to the charge transfer roller 26, the third causes a unit 252 to apply a biasing voltage to the magnetic brush cylinder 42, and the fourth activates the clutch 166 to cause the motor 158 to drive the cylinder 12 and the toner applicator 30.

In normal operation the passage of a sheet of paper advanced by the primary feed rollers holds the switch 70 closed as it is passing. This sends a signal to the counter 228 to deduct one from its count, energizes the solenoid 72 to free the arms 80 to enable them to bring the charge transfer roller against the sheet, and deenergizes the relay 234 and the timer 236.

If the switch 70 is not closed, that is to say if there is a failure in paper feed, the timer 236 energizes, after a time delay, a relay 254 which cuts off power from the relay 232. If the switch 70 closes but fails to open again, owing to failure of the paper to feed forward, the timer 242 operates, after a time delay, a relay 244 which also cuts off power from the relay 232. In either case the solenoid 66 is deenergized, thereby disabling the quadrant 54 from driving the primary feed rollers 38.

The count in the counter 228 is eventually reduced to zero by successive closures of the switch 70. The number of closures required is arranged in the counter to exceed by one the number shown on the counter to allow for the fact that the first sheet fed through the machine receives no toner. When the counter 228 reaches zero it mechanically closes a zero switch 256, which energizes the relay 258 and therefore the relay 222, which isolates the solenoid 66, to prevent further feeding of paper by the primary feed rollers. The switch 70 stays open, so that after a time the timer 236 energizes the relay 254, which cuts off power from the relay 232. This deenergizes the relay 234 so that the relay 254 is deenergized.

The timer 260 is actuated during the relaxed state of the relay 232 and, after a time delay, it energizes a relay 262 to effect deenergization of the relay 224, and to place a timer 264 in circuit. After a further time interval the relay 212 is energized by the timer 264 to open the switch 210, cut out the contactor 200 and switch off the machine.

The following safety switches are disposed in parallel with the zero switch 256:

a switch 266 which closes when the cover of the machine is not properly fitted, a switch 268 which closes if more than one sheet of paper is picked up by the primary feed rollers, and a switch 270 which closes when the magazine is empty of paper. Closure of any of these switches, or depression of a cycle stop button 272, energizes the relay 258 to stop the machine as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim as our invention and desire to secure by Letters Patent is:

1. An electrostatic duplicator, comprising:

a rotatable cylinder for supporting a master constituted by a sheet of material bearing an image to be duplicated, the image area of the master having an electrical resistivity which is substantially greater than that of the background area;

means for rotating the cylinder;

an applicator for applying toner powder only to the image area of the master on the cylinder subsequent to charging of the master by means of a charge transfer roller;

means for feeding transfer sheet material repeatedly into a nip between the cylinder and a charge transfer roller, to which nip the master is advanced from the applicator by rotation of the cylinder;

a source of electrical potential connected to the charge transfer roller, said charge transfer roller being the sole agency for imparting electrical charge to said master and operating simultaneously not only to cause toner powder to be transferred from the master to the transfer sheet material but also to cause the image area of the master to receive sufficient electrical charge upon passage of said transfer sheet material through said nip to enable the image area to pick up toner powder from the applicator; and a unit for fixing the toner powder to the transfer sheet material.

2. A duplicator according to claim 1, in which the fixing unit includes an internally heated drum, a belt partially encircling the drum and means for feeding the transfer material, after passage through the nip, between the belt and the drum with the surface carrying toner powder facing the drum.

3. A duplicator according to claim 1, which includes feed mechanism for feeding transfer sheets in succession to the nip and on to the fixing unit and further mechanism operating in timed relation with the feed mechanism for moving the charge transfer roller towards and away from the cylinder.

4. A duplicator according to claim 3, which includes a primary feed for feeding the sheets in succession from a magazine to a stop, a secondary feed, and a sensor responsive to arrival of a sheet at the stop for activating the secondary feed.

5. A duplicator according to claim 4, wherein the primary feed is constituted by feed rollers engaging the top sheet of a stack of sheets in the magazine and which includes mechanism for imparting incremental forward rotation to the feed rollers.

6. A duplicator according to claim 4, wherein the second feed includes initially separated upper and lower feed rollers and means operative when a sheet has engaged the stop for causing these feed rollers to grip the sheet.

7. A duplicator according to claim 3, which includes a subtractive counter on which can be set up the number of copies required, means for subtracting one unit from the counter in response to passage of each sheet and means for stopping operation of the duplicator when the count in the counter is reduced to zero.

8. A method of electrostatic printing from a master constituted by a sheet of material bearing an image to be duplicated, the image area of the master having an electrical resistivity which is substantially greater than that of the background area, which method comprises:

mounting the master on a rotating cylinder and, during each of a series of successive cycles of operation;

applying toner powder to only the electrically charged image areas of the master subsequent to charging of the master by means of a charge transfer roller;

traversing the master by rotation of the cylinder to a station at which it contacts successive portions of a transfer sheet which is pressed against the master by a charge transfer roller connected to a source of electrical potential such that simultaneously the toner is transferred to the transfer sheet and the image is recharged upon separation of the transfer sheet from the master, said charge transfer roller being the sole agency for imparting electrical charge to said master; and fixing the toner powder to the transfer sheet.

* * * * *